US006360684B1

(12) United States Patent
Quaglia

(10) Patent No.: US 6,360,684 B1
(45) Date of Patent: Mar. 26, 2002

(54) HAND DOWN INDICATOR INCLUDING POCKET

(76) Inventor: Kenneth L. Quaglia, 57 Power St., Norton, MA (US) 02766

( * ) Notice: Subject to any disclaimer, the term of this patent is extended or adjusted under 35 U.S.C. 154(b) by 0 days.

(21) Appl. No.: 09/300,927

(22) Filed: Apr. 28, 1999

(51) Int. Cl.[7] ..... A63B 71/06; A41D 20/00

(52) U.S. Cl. ..... 116/222; 116/306; 2/170; 224/576; 224/267

(58) Field of Search ..... 116/222, 306, 116/307; 2/170, 160, 161.1, 161.2; 224/576, 165, 219, 220, 221, 267; 33/2 R, 3 A, 501.08, 501.45, 650

(56) References Cited

U.S. PATENT DOCUMENTS

| | | | | | |
|---|---|---|---|---|---|
| 2,400,222 | A | * | 5/1946 | Cline | 224/165 |
| 3,120,213 | A | | 2/1964 | Mulligan | |
| 3,880,426 | A | | 4/1975 | Morse | |
| 4,164,910 | A | | 8/1979 | Feiler | |
| 4,176,839 | A | | 12/1979 | Pinkus | |
| D259,220 | S | | 5/1981 | Small et al. | |
| 4,462,116 | A | | 7/1984 | Sanzone et al. | |
| 4,465,232 | A | | 8/1984 | Field | |
| 4,557,215 | A | | 12/1985 | Petersson | |
| D283,943 | S | | 5/1986 | Rainey | |
| 4,809,366 | A | | 3/1989 | Pratt | |
| 4,905,881 | A | * | 3/1990 | Graber | 224/267 |
| 5,119,513 | A | | 6/1992 | McKay | |
| 5,150,475 | A | | 9/1992 | Hansen et al. | |
| D335,023 | S | | 4/1993 | Hutcheson | |
| D344,177 | S | | 2/1994 | Mennie et al. | |
| 5,341,972 | A | * | 8/1994 | Jacks | 224/165 |
| D354,840 | S | | 1/1995 | Geisler | |
| 5,466,215 | A | | 11/1995 | Lair et al. | |
| 5,472,125 | A | * | 12/1995 | Barnard | 224/219 |
| D369,893 | S | | 5/1996 | Thrussell | |
| 5,671,481 | A | | 9/1997 | Giard | |
| 5,704,067 | A | | 1/1998 | Brady | |
| 5,924,136 | A | * | 7/1999 | Ogean | 2/170 |
| 6,094,747 | A | * | 8/2000 | Malick | 2/170 |
| 6,112,961 | A | * | 9/2000 | Phillips | 224/219 |

FOREIGN PATENT DOCUMENTS

| | | | | |
|---|---|---|---|---|
| DE | 3023668 | * | 1/1982 | 224/219 |
| FR | 2476460 | * | 8/1981 | 224/267 |
| GB | 300883 | * | 11/1928 | 224/219 |

* cited by examiner

*Primary Examiner*—Andrew H. Hirshfeld
(74) *Attorney, Agent, or Firm*—Salter & Michaelson

(57) ABSTRACT

A hand-down indicator for aiding a football official in tracking play of an American-style football game including a pocket for holding and storing accessory items which may be easily accessed by the official during the game is provided. The down indicator also preferably includes an elastic wristband configured to be wrapped around the official's wrist, and a finger loop extending from the wristband. The pocket may be positioned on an inside surface of the wristband, or on an outside surface of the wristband and is sized to house the accessory items. In one embodiment, the pocket may include a flap for covering the open end of the pocket. In another embodiment, a cleat checking device which may be used by the official to check the size of a player's cleats during the game is removably supported within the pocket. The cleat checking device may also be attached to the finger loop to provide easy access thereto and to prevent misplacement of the cleat checking device. In another embodiment, the pocket includes two or more compartments for storing other accessory devices, such as the official's coin for the coin toss. During a football game, the official may insert and remove items within the pocket while tracking play of the game by selectively places the finger loop over one of his/her fingers.

8 Claims, 10 Drawing Sheets

HAND DOWN INDICATOR INCLUDING POCKET

DESCRIPTION

1. Technical Field

The invention relates generally to a hand down indicator for use by a sport's official in tracking play during a game, the indicator including a pocket for housing at least one accessory item, such as a cleat measuring device for measuring a legal shoe cleat, and providing easy access thereto during the game.

2. Background of Related Art

Sports officials, such as umpires and referees, must often perform various duties during the course of a game. Such duties include tracking the play of the game, make rulings on plays and checking equipment to see that it meets regulations. The officials often perform these multiple duties on the field of play, without returning to the sidelines or a home base so that play of the game is minimally interrupted. It is therefore advantageous if the officials can carry with them items which allow them to perform their various duties. Since officials are on the move, often running to keep up with the play of the game, carrying such items should not hinder their abilities to perform their duties and should not result in losing the items carried.

In the sport of American football, officials must likewise track the play of the game, for example the particular down. Hand down indicators are widely used in the sport of football and provide an easy way for officials to track play during a game. More specifically, conventional hand down indicators include an elastic wristband which is wrapped around the official's wrist, and a finger loop extending from the wristband. During a football game, the official selectively places the finger loop over one of his/her fingers in order to track play of the game. For example, the finger loop may be placed over the official's index finger to indicate a first down, may then be moved to the official's middle finger to indicate a second down, and may finally be moved to the official's ring finger to indicate a third down. Although hand down indicators perform well for their intended purpose, they do not aid the official in performing other duties, such as checking equipment to see if it meets regulations.

The sport of football has several regulations set regarding equipment which vary between high school, college and professional football. One such regulation involves the size of the player's shoe cleats. For example, the NCAA rules state that the size of a player's cleats may not be more than ½ inch in length as measured from the tip of the cleat to the sole of the shoe, or to a raised platform measuring 5/32 of an inch or less (Rule 1, Section 4, Articles 5e–f). Longer cleats may provide a team with a competitive advantage, depending upon ground conditions, and may also be a safety hazard. Therefore, the penalty for cleats which are not regulation size is severe, i.e. disqualification from the contest and the next game as well. If an official suspects that a player's cleats are too long, he/she must manually measure the cleats to determine if they do, in fact, meet or exceed the regulation size. In the past, officials have utilized a cut-out portion of the score card in order to check cleat sizing. However, the score cards are of paper covered plastic and readily deteriorate when soiled or wet (which usually occurs when checking cleat size) thereby limiting or destroying the ability of the score card to take an ink or pencil mark, i.e. the intended purpose of the score card. Therefore, many officials chose not to use the cut-out portion of the score card to check cleat size.

There is therefore needed in the art a device which can help an official track play of the game while also storing and providing easy access to accessory items utilized by officials during the game.

It is therefore an object of the present invention to provide a compact, self-contained hand-down indicator having at least one pocket for housing an accessory item, such as a cleat checking device, to aid the official in tracking play of the game while storing and providing easy access to the accessory item.

SUMMARY

In accordance with the present invention, there is provided a hand-down indicator for aiding a football official in tracking downs during an American-style football game, the down indicator including a pocket for holding and storing accessory items which may be easily accessed by the official during the game. The down indicator also preferably includes an elastic wristband configured to be wrapped around the official's wrist, and a finger loop extending from the wristband. The pocket may be positioned on an inside surface of the wristband, or on an outside surface of the wristband and is sized to house the accessory items. In one embodiment, the pocket may include a flap for covering the open end of the pocket. In another embodiment, a cleat checking device which may be used by the official to check the size of a player's cleats during the game is removably supported within the pocket. The cleat checking device may also be attached to the finger loop to provide easy access thereto and to prevent misplacement of the cleat checking device. In another embodiment, the pocket includes two or more compartments for storing other accessory devices, such as the official's coin for the coin toss. During a football game, the official may insert and remove items from within the pocket while tracking play of the game by selectively places the finger loop over one of his/her fingers as described above.

BRIEF DESCRIPTION OF THE DRAWINGS

It should be understood that the drawings are provided for the purpose of illustration only and are not intended to define the limits of the invention. The foregoing and other objects and advantages of the embodiments described herein will become apparent with reference to the following detailed description when taken in conjunction with the accompanying drawings in which.

DETAILED DESCRIPTION OF THE ILLUSTRATIVE EMBODIMENTS

Figure 1:
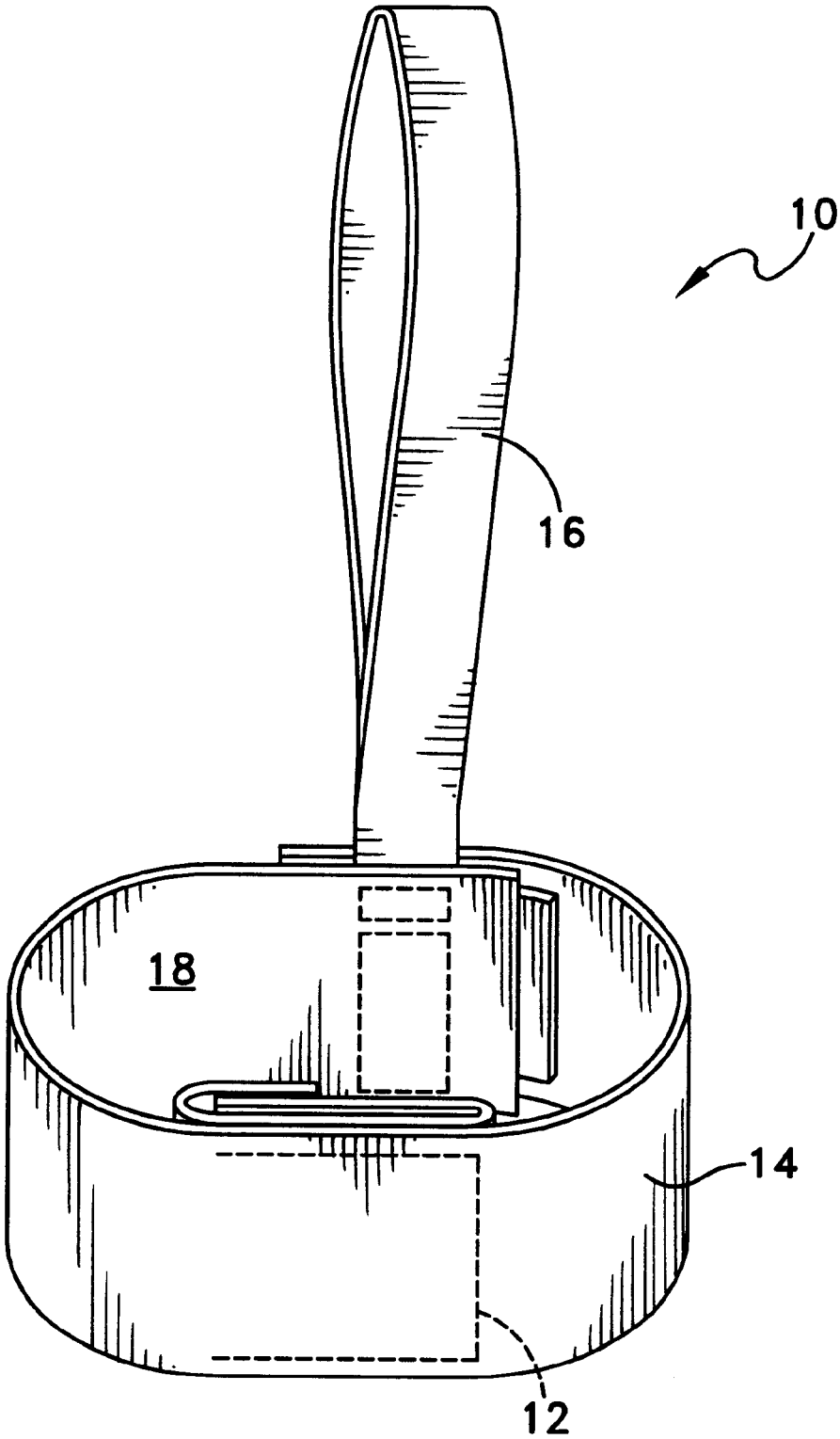
FIG. 1 is a perspective view of a first embodiment of a hand-down indicator according to the present invention.
Figure 2:
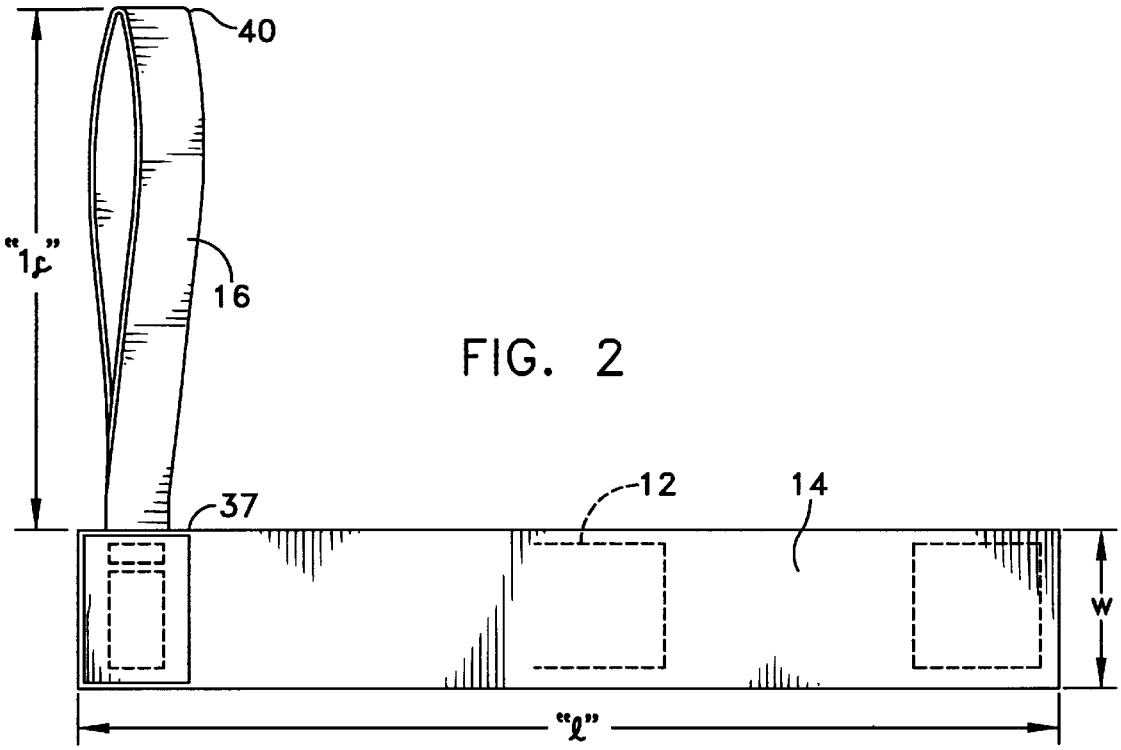
FIG. 2 is a front view of the down indicator of FIG. 1 with the wristband in an open position.
Figure 3:
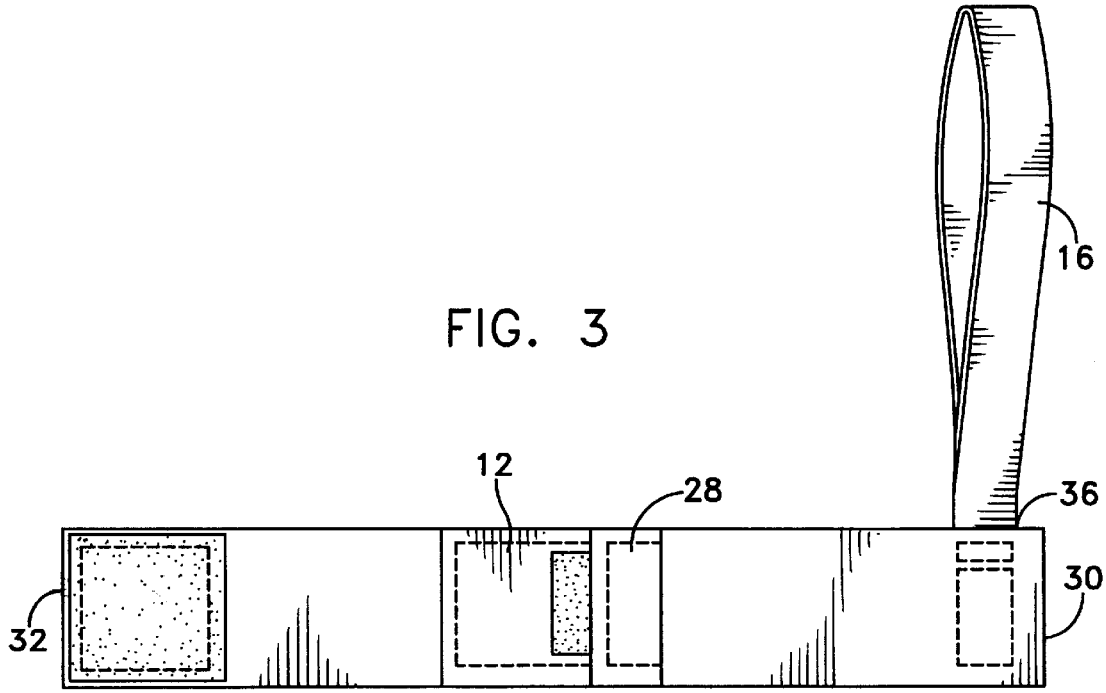
FIG. 3 is a rear view of the down indicator of FIG. 1 with the wristband in an open position.
Figure 6:
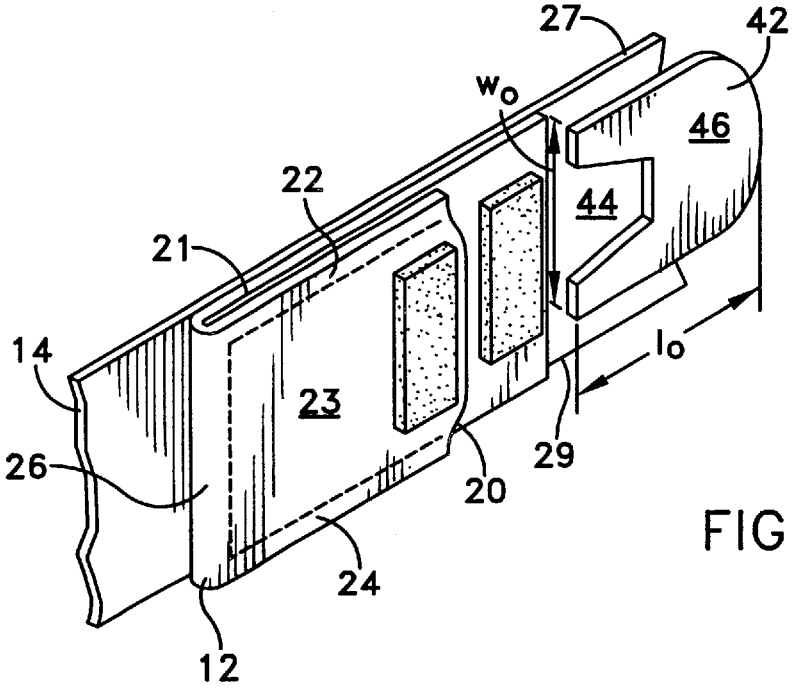
FIG. 6 is an enlarged rear view of the down indicator of FIG. 1 showing the pocket and flap in an open position and a cleat checking device sized to fit within the pocket.

A hand-down indicator 10 for aiding a football official in tracking play of an American-style football game including a pocket 12 for holding accessory items which may be easily accessed by the official during the game is illustrated in FIG. 1. In addition to pocket 12, the down indicator preferably includes a stretchable wristband 14 configured to be wrapped around the official's wrist and a finger loop 16 extending from the wristband. In the embodiment of FIG. 1, pocket 12 is preferably positioned on an inner surface 18 of the wristband 14 and extends in a longitudinal direction along a portion of the length "l" of the wristband (FIG. 2). The pocket includes an opening 20 for insertion of accessory items therein, a back wall 21 secured to the wristband 14 and a front wall 23 secured to back wall and wristband. In the present embodiment, a single strip of material may be folded over itself to form the pocket, the strip being attached at a first side 22, a second side 24 and a bottom portion 26, for example by sewing, to the inner surface of the wristband. Alternately, the wristband itself may form the back wall of the pocket in which case the strip of material would not be folded over itself. As shown in FIG. 6, the pocket 12 may be positioned on a central portion of the wristband such that the pocket lies against the inside of the wearer's wrist during use. Alternately, the pocket may be positioned anywhere along the length of the wristband.

Figure 4:
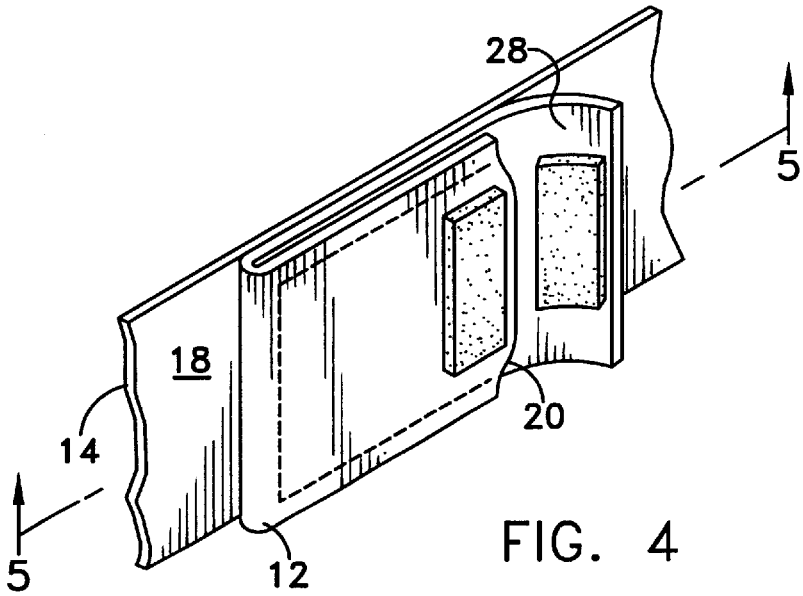
FIG. 4 is an enlarged rear view of the down indicator of FIG. 1 showing the pocket and flap in an open position.
Figure 5:
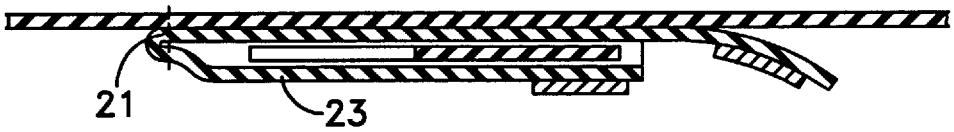
FIG. 5 is a partial cross-sectional view of the down indicator taken along line 5—5 of FIG. 4.

Referring now to FIGS. 4–6, the pocket may further include a flap 28 for covering opening 20 so that items disposed within the pocket will not slip out of the pocket. The flap may be closed by a fastener, such as Velcro® material, with a hook portion being positioned on either the flap or an outer surface of the pocket, and the loop portion being positioned on the opposite surface. Other fasteners may also be utilized or the pocket may not include a flap or cover, as would be known to one of skill in the art. The pocket may, alternately be positioned transverse to the length of the wristband such that the opening of the pocket is disposed adjacent a top 27 or bottom 29 edge of the wristband. However, positioning the pocket, and hence opening longitudinally along the wristband is believed to provide added security in retaining items within the pocket for the present embodiment.

Wristband 14 is designed to be wrapped around an average wearer's wrist, and is preferably constructed from an elastic material which is capable of stretching in a longitudinal or lengthwise direction. In the present embodiment, wristband 14 is preferably from about 8.5–9.5 inches long ("l"), unstretched, and is preferably from about 1.5–2.0 inches wide ("w"), although other lengths and widths may be utilized, as would be known to one of skill in the art. The wristband 14 includes a first end 30 which is securable to a second end 32 of the wristband in order to fasten the wristband around the wrist of the official. In the present embodiment, a fastener such as Velcro® material is utilized to releasably and adjustably secure the first end 30 to the second end 32. A loop portion of the Velcro® material may be positioned on either the first or second end, with a hook portion being positioned on the opposite end. In the present embodiment, the loop portion is positioned on the first end 30 and the hook portion is secured to the second end 32. Other fasteners may also be utilized as would be known to those of skill in the art.

Figure 7:
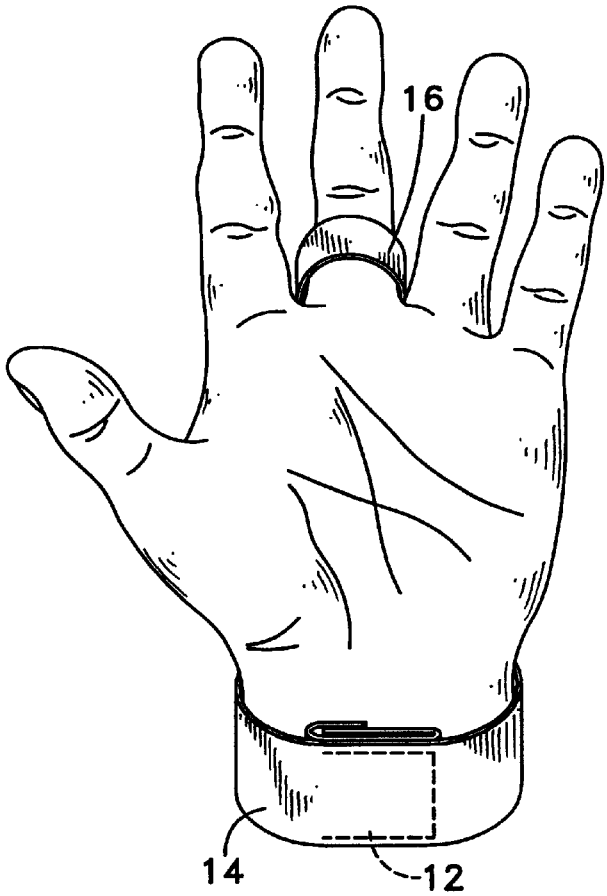
FIG. 7 is a rear view of an official's hand with the down indicator of FIG. 1 in place and indicating a second down.
Figure 8:
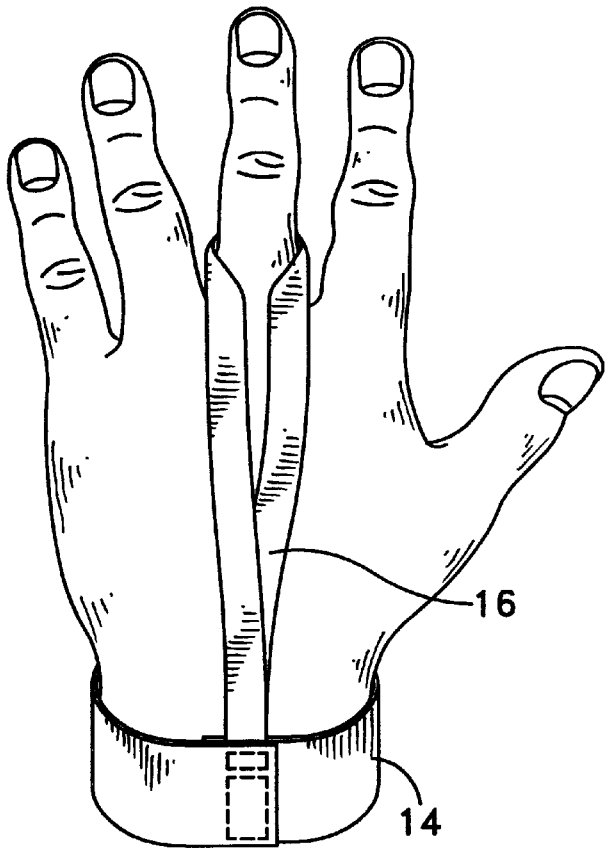
FIG. 8 is a front view of an official's hand with the down indicator of FIG. 1 in place and indicating a second down.
Figure 9:
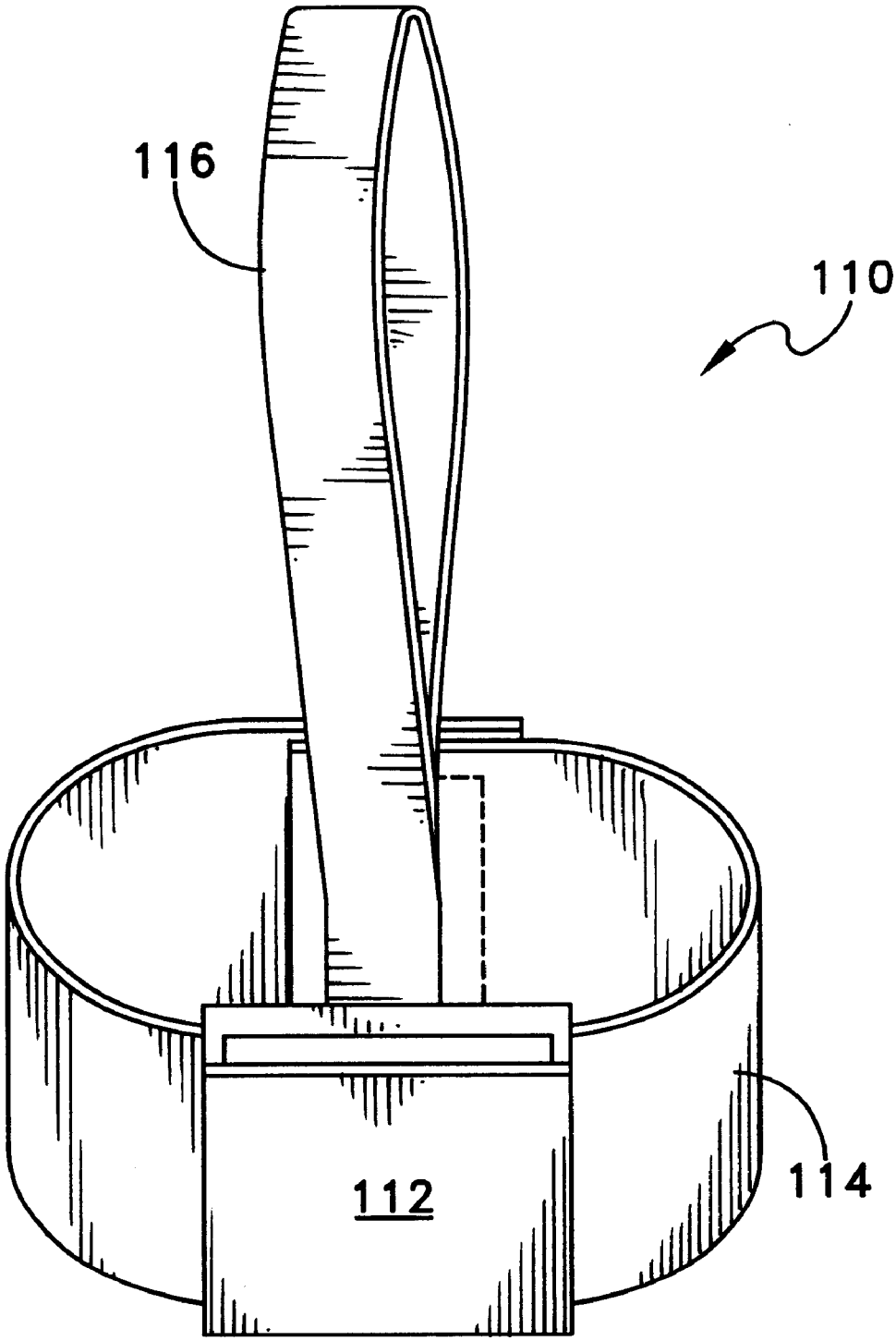
FIG. 9 is a perspective view of a second embodiment of a hand-down indicator including multiple compartments, according to the present invention.
Figure 10:
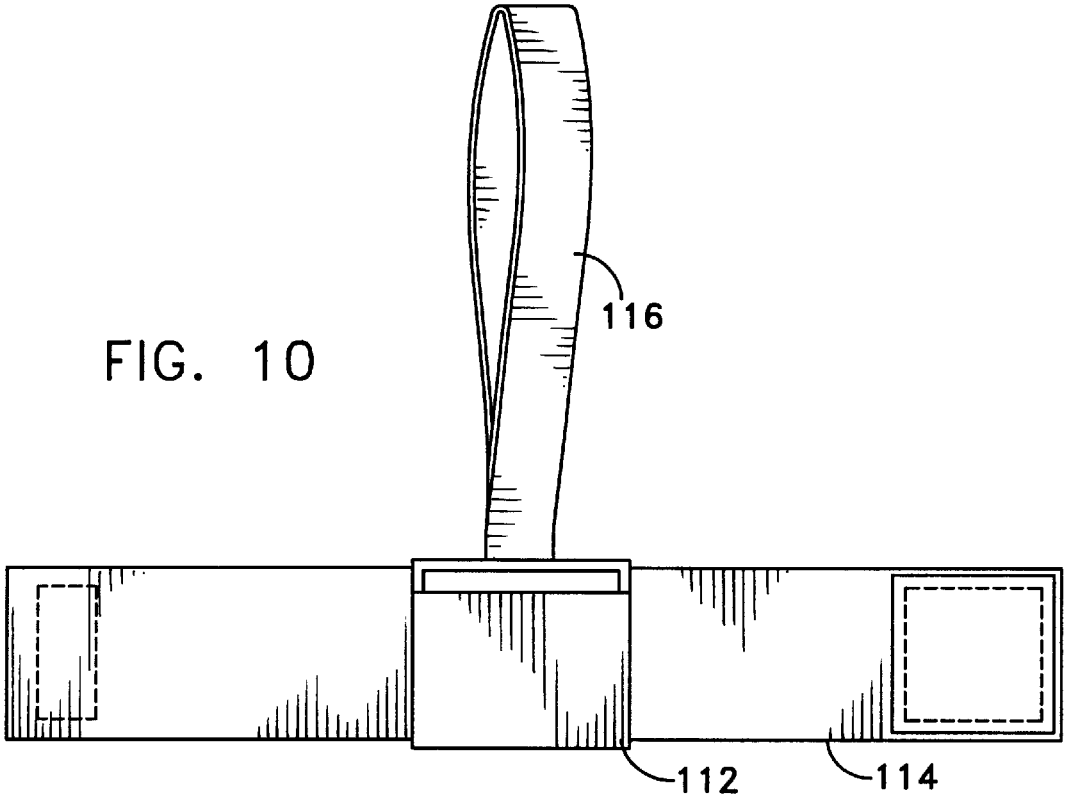
FIG. 10 is a front view of the down indicator of FIG. 9 with the wristband in an open position.
Figure 11:
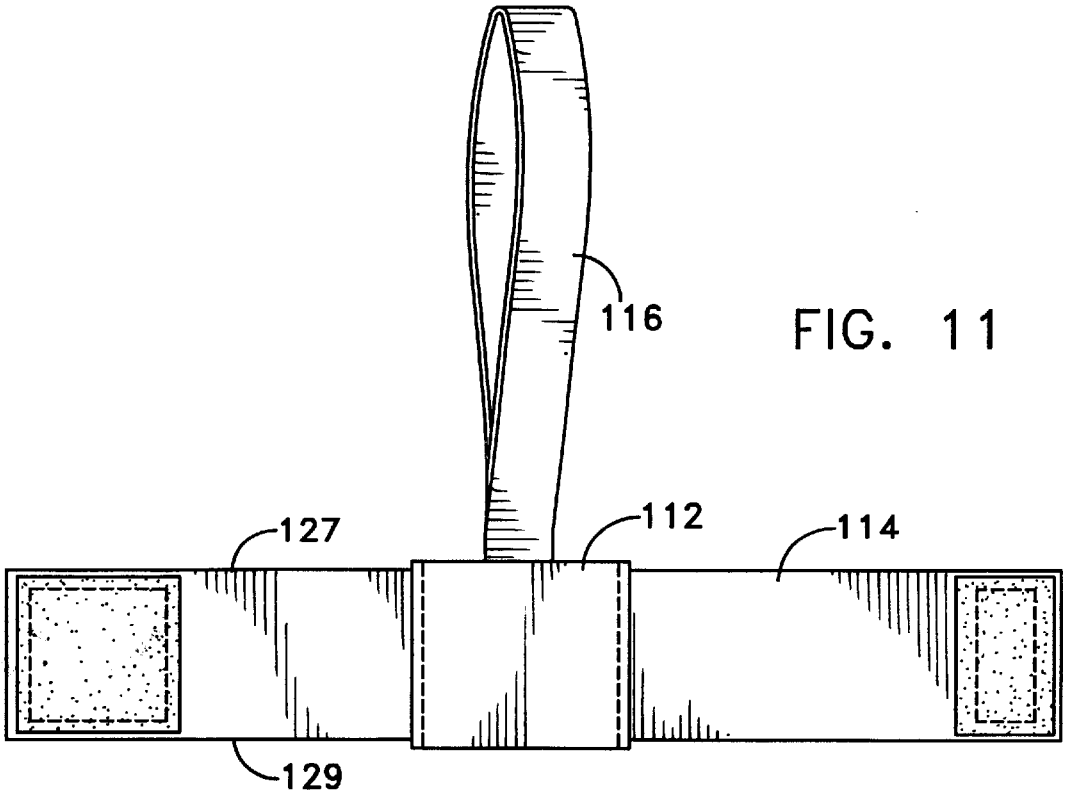
FIG. 11 is a rear view of the down indicator of FIG. 9 with the wristband in an open position.

Extending from wristband 14 and secured thereto is finger loop 16. As described hereinabove, the finger loop is provided so that the official may track play of the game, for example the down or hash marks. Finger loop 16 is preferably secured at a first end 36 thereof to wristband 14. For the embodiment of FIGS. 1–8, the first end 36 of the finger loop is secured to the first end 30 of the wristband and is preferably disposed between the wristband and the loop or hook portion of the fastener for the wearer's comfort. The finger loop may be secured in any known manner, and is preferably sewn to the wristband in the present embodiment. Alternately, the finger loop may be secured anywhere along the length of the wristband, as would be known to one of skill in the art. The finger loop may also be made of elastic material and is designed to extend from the wristband over the back of the wearer's hand and to be selectively positioned over one of the wearer's fingers, as shown in FIGS. 7 and 8. In the present embodiment, the length of the finger loop "$l_f$" as measured from the top edge 27 of the wristband to a second end 40 of the finger loop is from about 3.5–5 inches.

The combination of the wristband, finger loop and pocket allows the official to track play during a game while housing accessory items which may be easily accessed and used by the official during the game. Such accessory items may include, for example, a cleat measuring device 42. Cleat measuring device 42 is sized to fit within pocket 12 and includes a cut-out portion 44 for receiving and measuring the length of a player's cleat therein and a body portion 46 for grasping by the official. Cut-out portion 44 is preferably tapered to correspond to the profile of most standard cleats and is sized according to the appropriate regulation or standard. For example, for use in the sport of collegiate football the cut-out is about ½ inch in length such that any cleats which extend beyond the cut-out portion would not be regulation. The cleat measuring device may preferably be made of a relatively stiff and durable material, and may be from about 2–3 inches in overall length "$l_o$" and from about 1–1.5 inches in width "$w_o$" at its widest point. In the present embodiment, the body portion of the cleat measuring device includes a rounded end to facilitate insertion and withdrawal of the cleat measuring device within the pocket.

Figure 12:
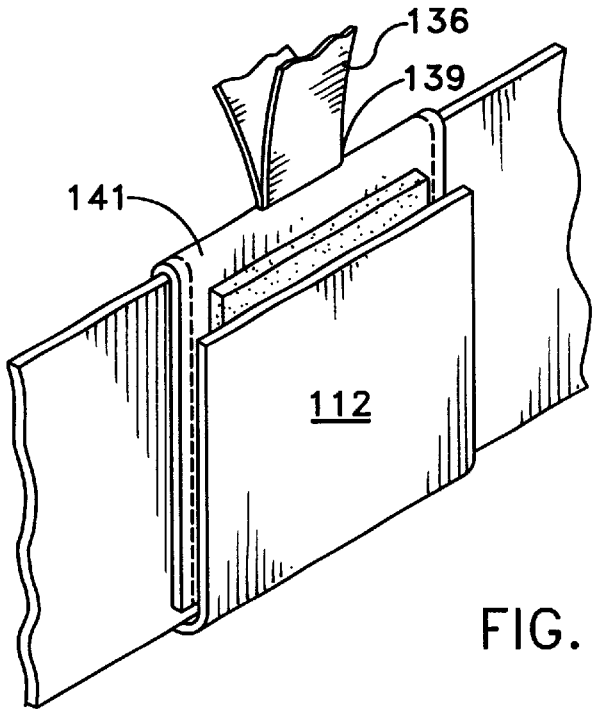
FIG. 12 is an enlarged, partial front view of the down indicator of FIG. 9 showing the pocket and the finger loop extending into the pocket.
Figure 13:
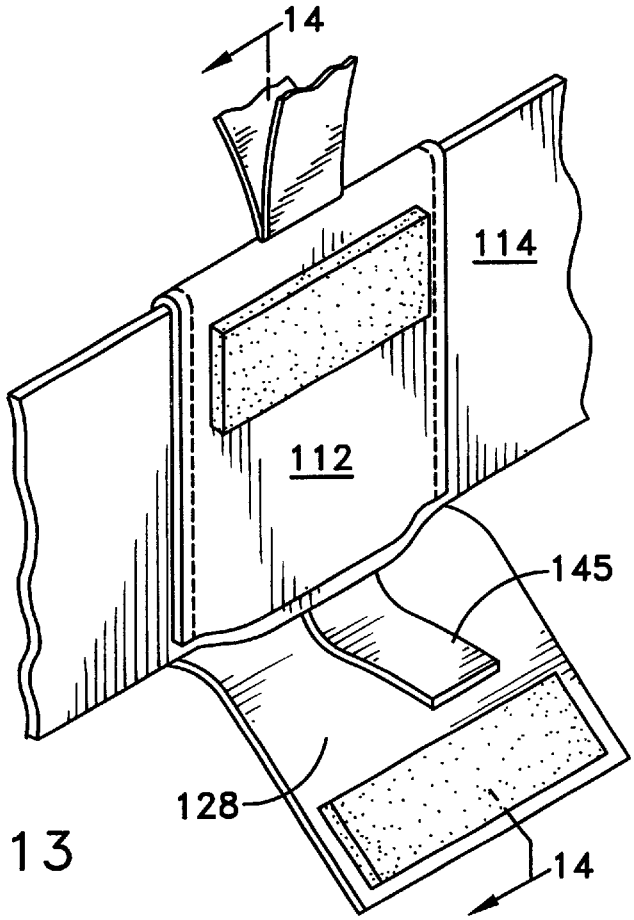
FIG. 13 is an enlarged, partial front view of the down indicator of FIG. 9 showing the pocket and flap in an open position, the finger loop extending into the pocket and a strap extending from the pocket.
Figure 14:
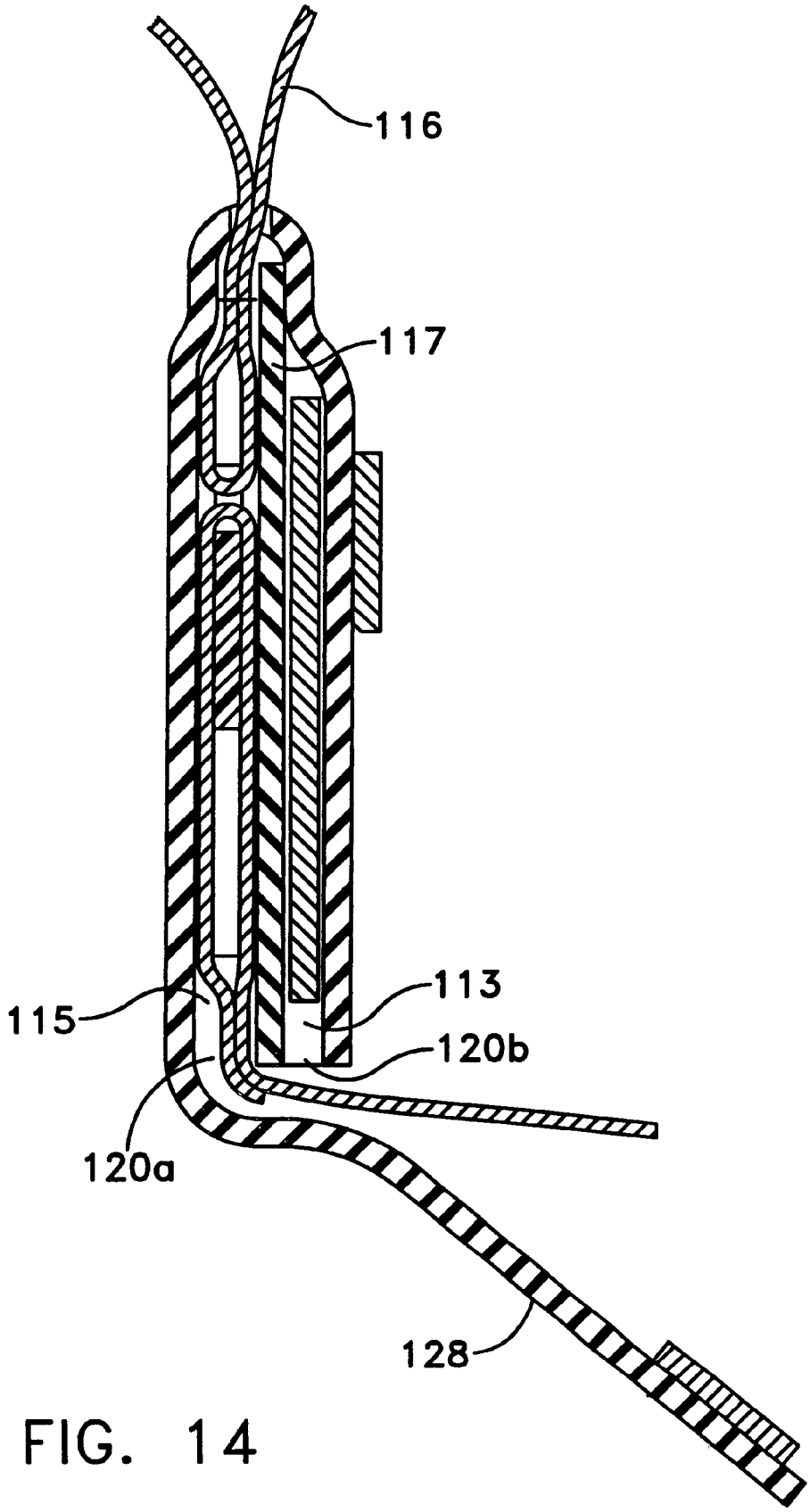
FIG. 14 is a partial cross-sectional view of the down indicator of FIG. 9 taken along line 14—14 of FIG. 13.

Referring now to FIGS. 9–17, an alternate embodiment of the hand down indicator including a pocket having multiple compartments is illustrated. In this embodiment, all parts which are the same, or similar to, corresponding parts of the embodiment 10 are noted with the same two last numbers, but preceded by the numeral "l". Down indicator 110 includes a stretchable wristband 114 configured to be wrapped around the official's wrist, a finger loop 116 extending from the wristband, and a pocket 112 including compartments 113 and 115 for holding accessory items which may be easily accessed by the official during the game. In the present embodiment, compartments 113 and 115 are preferably positioned on either side of wristband 114 such that the wristband forms a common wall 117 between the compartments, and may be disposed transverse to the length of the wristband. Each compartment includes an opening 120*a,b* (FIG. 14) for insertion of accessory items therein, the openings of the compartments being disposed adjacent either a top 127 or bottom 129 edge of the wristband in the present embodiment. As shown in FIGS. 12–14, pocket 112 and compartments 113, 115 may be formed from a single piece or strip of material which is folded over either the top or bottom edge of the wristband. The strip of material may be secured to the wristband in any known manner, for example by sewing as described hereinabove. A portion of the strip of material may extend beyond the width of the wristband so as to form flap 128 for covering openings 120*a, b* so that items disposed within the compartments will not slip out. The flap may be closed by a fastener, such as Velcro® material, with a hook portion being positioned on either the flap or outer surface of the pocket and loop portion being positioned on the opposite surface. Other fasteners may also be utilized or the pocket may not include a flap or cover, as would be known to one of skill in the art. The pocket may, alternately be positioned longitudinally along the length of the wristband such that the openings of the compartments are disposed transverse to the top or bottom edge of the wristband.

Figure 15:
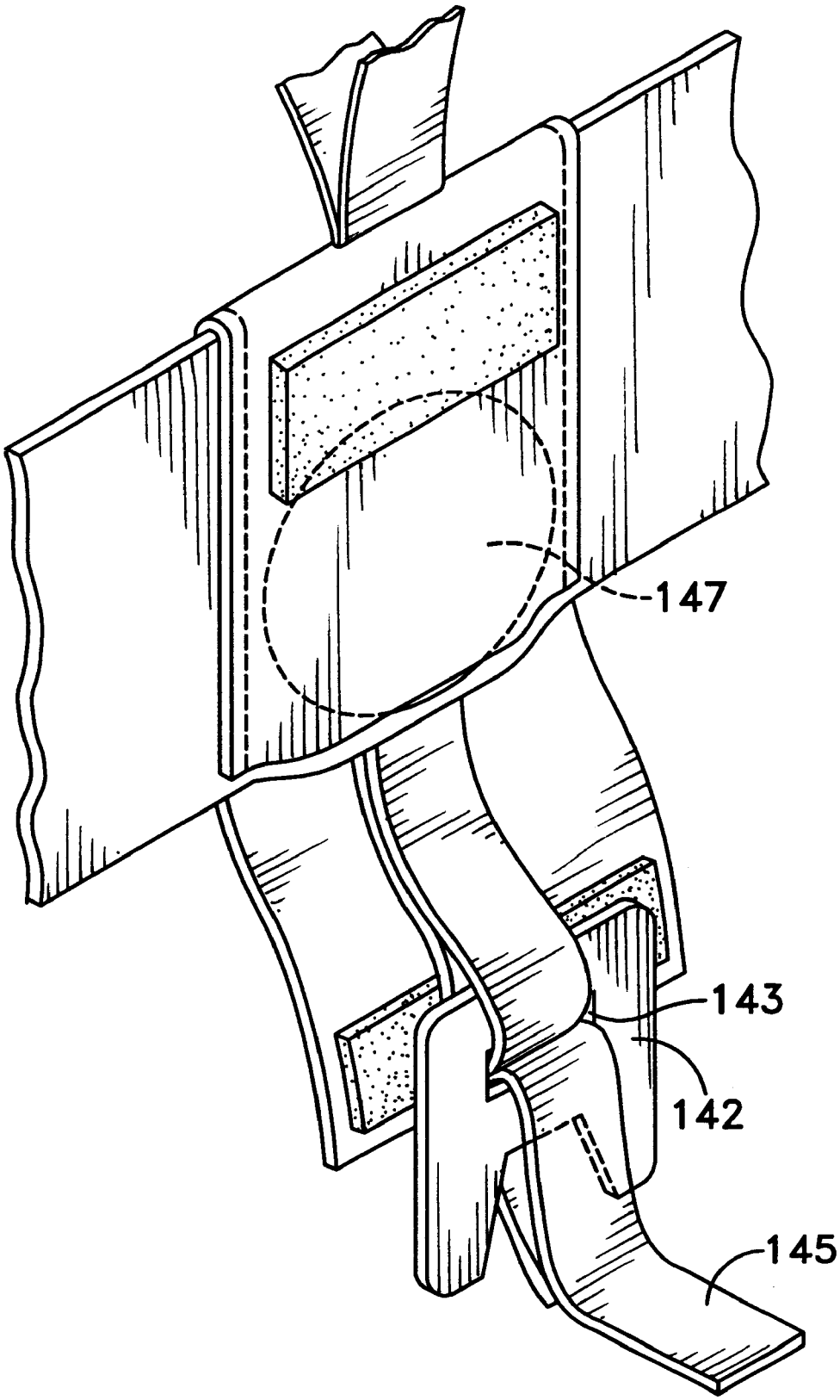
FIG. 15 is an enlarged, partial front view of the down indicator of FIG. 9 showing the pocket and flap in an open position, a cleat checking device sized to fit within the pocket, the finger loop and strap connected to the cleat checking device.
Figure 16:
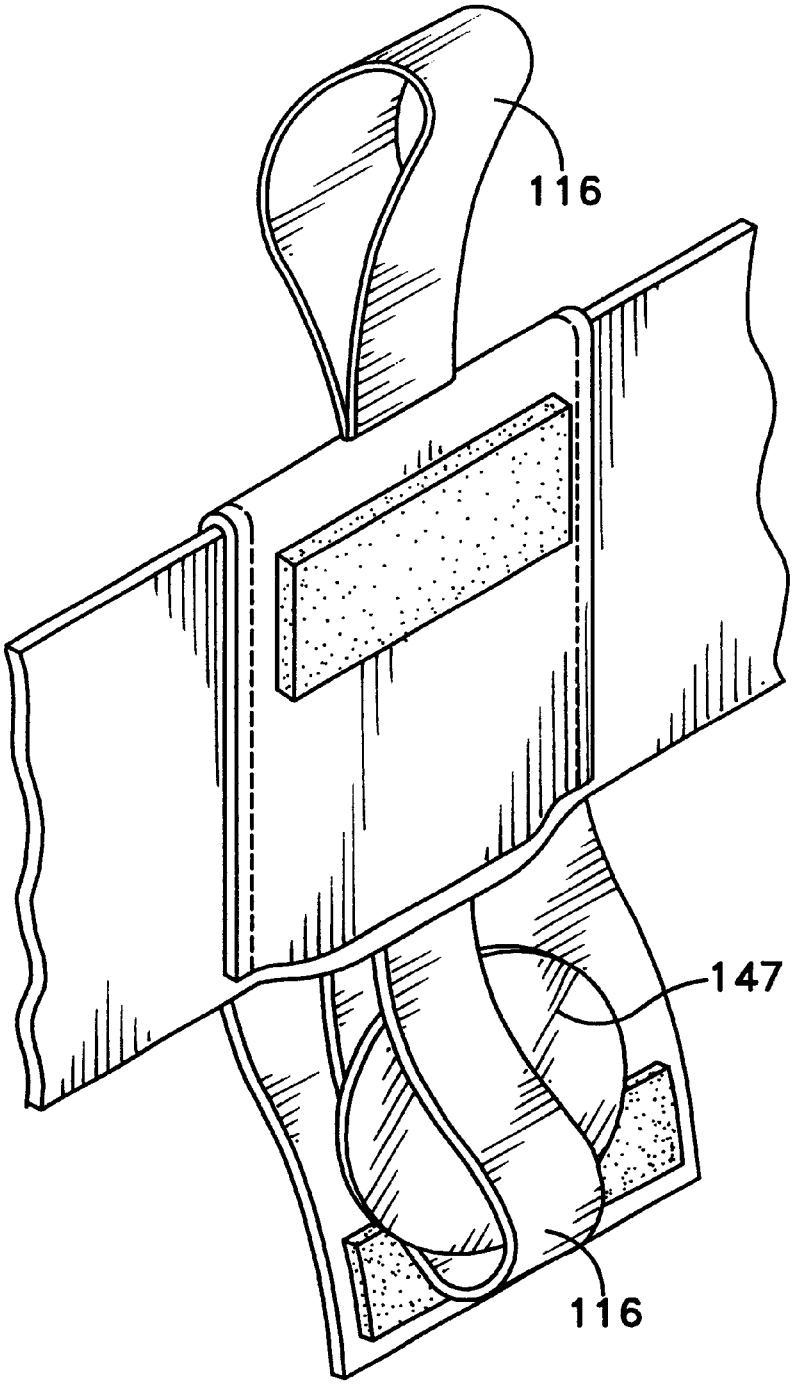
FIG. 16 is an enlarged, partial front view of the down indicator of FIG. 9 showing the pocket and flap in an open position with the finger loop extending through the pocket and engaging a coin.

For the embodiment of FIGS. 9–17, the first end 136 of the finger loop 116 is disposed through a slot 139 formed through a bottom portion 141 of the pocket 112 and is constructed to secure or attach an accessory item disposed within one of the compartments. For example, cleat measuring device 142 may include an opening 143 for receiving the finger loop therethrough as shown in FIG. 15. An additional strap 145 may also be attached through opening 143 in order to aid in the removal of the cleat measuring device from the pocket. A second accessory item, such as an official's coin 147, may be disposed in the second compartment (FIGS. 14–15). Alternately, the first end of the finger loop may simply be disposed around the accessory item, for example the coin as shown in FIG. 16, or may be secured to either the pocket or wristband instead of being disposed through the slot 139. Use of the hand down indicator with pocket will now be described with reference to the figures.

In use, the official can place one or more accessory items into the pocket of the hand down indicator, for example the cleat measuring device and/or official's coin. The accessory items may be loosely placed within the pocket or may be secured or attached to the finger loop of the device as described above. In this connection, although the finger loop is shown in FIGS. 14 and 15 as being permanently attached to the cleat measuring device, the finger loop may be removably attached to the accessory item, for example by providing the finger loop with a fastener so that the loop can be opened and closed at one end thereof. Once the official has placed the accessory items within the pocket or compartments, the flap can be fastened closed in order to secure the items therein. The wristband is then positioned around the official's wrist and is secured thereto by attaching the first end of the wristband to the second end. The second end of the finger loop is then selectively positioned around one of the official's fingers, as shown in FIGS. 7 and 8, in order to aid the official in tracking play of the game. During the game, the official will repeatedly move the finger loop between fingers in order to track play. If necessary, the official may readily access the items housed within the pocket of the down indicator by lifting the flap and grasping the items. If a flap is not provided, the official need only grasp the items to remove them from the pocket. Due to the elasticity of the wrist band and/or the positioning of the pocket, the official may remove the items without taking the down indicator off of his or her wrist. If the accessory item is supported by the finger loop as shown in FIG. 15, the official may need to remove the finger loop from his or her finger in order to access the accessory item. If a strap is likewise attached to the accessory item, as described above, the official may grasp the strap to aid in removal of the item from the pocket. Thereafter, the accessory item may be readily inserted into the pocket or compartment of the down indicator by the official, again without removing the wrist band. Thus, the hand down indicator with pocket provides a compact, self-contained device for housing accessory items, which aids the official in tracking play of the game while storing and providing easy access to the accessory item.

It will be understood that various modifications may be made to the embodiment disclosed herein. For example, the pocket may be provided with additional compartments in excess of two or more than one pocket may be provided instead of a single pocket with multiple compartments. In addition, the dimensions provided herein are not to be construed as limiting, but only as examples. There may also be a variety of different accessory items stored within the pocket, other than the items discussed herein. Therefore, the above description should not be construed as limiting, but merely as exemplifications of a preferred embodiment. Those skilled in the art will envision other modifications within the scope spirit of the invention.

What is claimed is:

1. A hand down indicator for aiding an official in tracking play of a game and for storing items used by the official during the game the down indicator comprising:

a wristband constructed and arranged to be wrapped around a wrist of the official;

a finger loop including a first end supported by the wristband and a second end constructed and arranged to be selectively positioned over a finger of the official;

a piece of material secured to a surface of the wristband so as to form a pocket including an opening at one end thereof and defining a first compartment disposed on an inner surface of the wristband and a second compartment disposed on an outer surface of the wristband such that the wristband forms a common wall between the first and second compartments, the first and second compartments being constructed and arranged to receive at least one accessory item therein; and wherein selectively positioning the finger loop over one of the official's fingers aids the official in tracking play of the game and wherein the pocket stores the at least one accessory item while providing easy access thereto during the game.

2. The down indicator of claim 1, wherein the first and second compartments are formed from a single strip of material which is folded over one edge of the wristband and is secured to the inner and outer surfaces of the wristband.

3. The down indicator of claim 2, wherein a portion of the strip of material extends beyond a width of the wristband so as to form a flap for covering the opening of the pocket in a closed position.

4. The down indicator of claim 1 in combination with the at least one accessory item, the at least one accessory item being removably supported within the pocket.

5. The combination of claim 4, wherein the at least one accessory item is a cleat measuring device including a cut-out portion configured and dimensioned to receive a player's cleat therein so as to determine if the cleat is regulation size, and a body portion constructed and arranged to be grasped by the official.

6. The down indicator of claim 1, wherein the first end of the finger loop is disposed within one of the first and second compartments and is attachable to the at least one accessory item so as to aid in securing the accessory item within the pocket.

7. A hand down indicator for aiding an official in tracking the down in an American-style football game and for storing items used by the official during the game, the down indicator comprising:

a wristband constructed and arranged to be wrapped around a wrist of the official;

a finger loop including a first end supported by the wristband and a second end constructed and arranged to be selectively positioned over a finger of the official;

a piece of material secured to a surface of the wristband so as to form a pocket including an opening positioned centrally along a length of the wristband such that the pocket and opening lay against either the inner or outer portion of the official's wrist during use, the pocket and opening being constructed and arranged to receive a cleat measuring device therein and a flap for covering the opening of the pocket in a closed position;

a cleat measuring device removably supported within the pocket and including a cut-out portion configured and dimensioned to receive a player's cleat therein so as to determine if the cleat is regulation size, and a body portion constructed and arranged to be grasped by the official; and wherein the first end of the finger loop is disposed within the pocket and is attached to the cleat measuring device so as to aid in securing the cleat measuring device within the pocket and wherein selectively positioning the finger loop over one of the official's fingers aids the official in tracking the down in the game and wherein the pocket stores the cleat measuring device while providing easy access thereto during the game.

8. The down indicator of claim 7, wherein the pocket includes a first compartment constructed and arranged to receive the cleat measuring device therein, and a second compartment constructed and arranged to receive an accessory item therein.

* * * * *